United States Patent [19]

Watson et al.

[11] 4,049,426

[45] Sept. 20, 1977

[54] COPPER-BASE ALLOYS CONTAINING CHROMIUM, NIOBIUM AND ZIRCONIUM

[75] Inventors: W. Gary Watson, Cheshire; John F. Breedis, Trumbull, both of Conn.

[73] Assignee: Olin Corporation, New Haven, Conn.

[21] Appl. No.: 728,977

[22] Filed: Oct. 4, 1976

[51] Int. Cl.[2] ..... C22F 1/08

[52] U.S. Cl. ..... 75/153; 148/12.7 C; 148/32.5; 148/160

[58] Field of Search ..... 75/153; 148/12.7 C, 148/32.5, 160

[56] References Cited

U.S. PATENT DOCUMENTS

| | | | |
|---|---|---|---|
| 3,143,442 | 8/1964 | Watts | 148/160 |
| 3,357,824 | 12/1967 | Saarvita | 148/160 |
| 3,881,965 | 5/1975 | Matsuda et al. | 148/12.7 C |
| 3,969,156 | 7/1976 | Wallbaum | 148/12.7 C |

*Primary Examiner*—W. Stallard

*Attorney, Agent, or Firm*—Robert A. Dawson; Robert H. Bachman

[57] ABSTRACT

Copper base alloys containing chromium, zirconium and niobium are disclosed as well as a process of heat treating and mechanically working said alloys. The combination of alloying elements, hot and cold working, annealing and aging steps increases both the strength and electrical conductivity properties of the alloy without excessive cold working.

20 Claims, No Drawings

COPPER-BASE ALLOYS CONTAINING CHROMIUM, NIOBIUM AND ZIRCONIUM

BACKGROUND OF THE INVENTION

Commercially useful copper base alloys should possess a combination of high strength and high electrical conductivity for most applications. Unfortunately, the methods and elements previously utilized to provide an increase in one of these properties do so at the detriment of the other property. For example, elements such as zirconium and chromium have been used as additions to copper base alloys to provide this desirable combination of high strength and high electrical conductivity. The precipitation of chromium in copper is known to give large increases in strength and electrical conductivity over the values for the solid solution of copper and chromium. The precipitation hardened alloys containing chromium in copper have lower electrical conductivity but higher strength than pure copper. Precipitation of zirconium in copper is known to give large increases in electrical conductivity but only small increases in strength properties over the values for the solid solution of zironium in copper. Zirconium also significantly raises the recrystallization temperature of copper. These alloys have lower electrical conductivity properties than pure copper but a much better resistance to softening at high temperatures than pure copper.

Vanadium has recently been utilized to provide the combination of high strength and high electrical conductivity. For example, copending application Ser. No. 652,997 filed Jan. 28, 1976 discusses the effects of adding vanadium to copper base alloys containing chromium and zirconium. Russian Pat. No. 185,068 also discloses copper base alloys that contain chromium, zirconium and vanadium. This patent does not teach any processing steps for this alloy combination.

The present invention is an attempt to overcome the shortcomings of the alloy system described above by combining niobium with copper base alloys containing chromium and zirconium in order to increase the electrical conductivity of the alloys without detrimentally affecting the strength or hardness properties of said alloys.

Accordingly, it is a principal object of the present invention to provide an alloy system which is capable of improving the electrical conductivity without lowering the strength properties of said alloy system.

It is an additional object of the present invention to provide a process for treating the alloy system as aforesaid to develop the electrical conductivity and strength properties thereof.

Further objects and advantages of the present invention will become more apparent from a consideration of the following specification.

SUMMARY OF THE INVENTION

In accordance with the present invention it has been found that the foregoing objects and advantages may be readily achieved by providing a copper base alloy system containing 0.05 to 1.25% by weight chromium, 0.05 to 1.0% by weight zirconium, 0.05 to 1.5% by weight niobium, balance essentially copper.

This alloy system may be processed according to the following steps:

a. casting a copper base alloy containing 0.05–1.25% by weight chromium, 0.05–1.0% by weight zirconium, 0.05–1.5% by weight niobium, balance essentially copper;

$b_1$. hot working the alloy at a starting temperature of 850°–950° C; or $b_2$. hot working the alloy at a starting temperature of 950°–1000° C to effect the maximum solid solution of all alloying elements;

c. if step ($b_1$) has been utilized, solution annealing the worked alloy at a solutionizing temperature of 950°–1000° C, preferably 975°–1000° C, for a period of time sufficient to insure the maximum solid solution of the alloying elements;

d. rapidly cooling the alloy to maintain said maximum solid solution of all alloying elements;

e. cold working the alloy to a total reduction of at least 60 percent and preferably to at least 75 percent;

f. aging said alloy at 400°–500° C for one to 24 hours and preferably 430°–470° C for 2 to 10 hours; and g. optionally cold working said alloy to the final desired temper.

DETAILED DESCRIPTION

The present invention provides its combination of strength and electrical conductivity properties through a combination of the novel alloy system and the steps of casting this alloy system, hot working the alloy at 850°–950° C or hot working the alloy in such a manner so as to effect the maximum solid solution of all alloying elements, solution annealing the hot worked alloy, if hot worked at 850°–950° C, rapidly cooling the alloy so as to maintain said maximum solid solution, cold working the alloy and aging the alloy.

The hot working step of the processing utilized in the present invention may by itself be used to provide the effect of solution annealing. This is generally accomplished by performing the hot working at a temperature which is high enough to place all of the alloying elements into maximum solid solution. This temperature should be at least 950° C with a preferred temperature range of 975°–1000° C to insure said maximum solid solution.

The alloys utilized in said process are generally cast at a temperature which ranges between 25° C above the melting point of the alloy up to approximately 1300° C. This casting may be performed by any known and convenient method.

The hot working reduction requirement is generally what is most convenient for further working. The process utilized in the present invention has no particular dimensional requirements other than that the hot working be accomplished according to good mill practice. If the hot working step is also utilized to provide the solution annealing of the alloy, the main consideration is that the hot working be performed to effect the maximum solid solution of all the alloying elements. This permits the later precipitation during aging of the most desirable high volume fraction of fine uniform dispersions of intermediate solid phases consisting of chromium, zirconium and niobium, the phases existing in the alloy matrix either as dependent or intermixed phases. The solution annealing step of the process utilized in the present invention, whether performed as part of the hot working step or as a separate step after hot working, also provides for the maximum solid solution of all the alloying elements. This solution annealing is accomplished at a temperature between 950° and 1000° C. It is preferred that the solution annealing be accomplished at a temperature between 975° and 1000° C. It should be noted that this solution annealing step can take place at any point in the instant process after the initial hot working step, provided that rapid cooling, cold working and aging steps with optional cold working after aging are performed after the solution annealing step.

The alloy, after being either hot worked alone or hot worked in combination with a separate solution annealing step, is then rapidly cooled so as to maintain the maximum solid solution of all alloying elements. Cooling to 350° C or less is necessary to maintain said maximum solid solution. This cooling may be accomplished according to procedures well known in this art, using either air or liquid as the cooling medium.

The next step in the process utilized in the present invention is cold working of the alloy. This cold working step is utilized to provide an increase in strength to the alloy as well as being used to meet dimensional requirements. The alloy is generally cold worked to an initial reduction of at least 60 percent and preferably at least 75 percent. This relatively high cold reduction serves to impart more strain hardening to the alloy prior to aging as well as impart improvement in the electrical conductivity of the aged alloy. The improvement in electrical conductivity after aging of the alloy is presumably brought about by altering the kinetics of precipitation in the alloy matrix. This cold working step may be the final cold working before aging of the alloy if the alloy is reduced to the final desired dimensions. The cold working may be utilized in cycles with the aging so that a cycle may end with either an aging step or a cold working step.

The initial cold working of the alloy is followed by an aging step. This aging is generally performed at a temperature between 400°–500° C for one to 24 hours, preferably at 430°–470° C for 2 to 10 hours. This aging is performed to increase the mechanical and electrical conductivity properties of the alloy. At least one aging step is required in the process utilized in the present invention.

As stated above, the treatment of the alloy may stop with the aging step or the alloy may be further cold worked to meet desired dimensional requirements. This further cold working step is performed to give the aged alloy the desired final temper. Minimum percentage reduction will depend upon the temperature desired. For example, a "hard" temper will require approximately 37 percent reduction while "special spring" temper will require approximately 75 percent reduction in the worked alloy. The procedures of aging and cold working may be accomplished in cycles, with as many cycles being used as desired in order to meet desired properties.

The alloy of the present invention may have additional elements added to it to control the precipitation response of the alloy. These elements may include arsenic, magnesium, cobalt, boron, calcium, cadmium and mischmetal. The preferred percentages of the three main alloying elements are from 0.5 to 1.0% by weight chromium, 0.1 to 0.4% by weight zirconium, 0.1 to 0.4% by weight niobium, balance essentially copper.

The alloy system and process of the present invention and the advantages obtained thereby may be more readily understood from a consideration of the following illustrative examples.

EXAMPLE I

An alloy having a composition of 0.55% by weight chromium, 0.15% by weight zirconium, 0.25% by weight niobium, balance essentially copper was processed according to a sequence defined by hot working, solution annealing at a temperature above 950° C to effect a supersaturated solid solution and cold worked both before and after a precipitation heat treatment, achieved properties illustrated in Table I. These properties were compared to an alloy system with its own processing from the literature. This other alloy system contained 0.40% by weight chromium, 0.15% by weight zirconium, 0.05% by weight magnesium, balance essentially copper. The results for both alloy systems are shown in Table I.

TABLE I

ELECTRICAL CONDUCTIVITY AND STRENGTH COMPARISON PROPERTIES

| Processing | UTS (ksi) | 0.2% YS (ksi) | % IACS |
|---|---|---|---|
| S.A. + 75% CR + 450° C/2 hrs. (A) | 83 | 77 | 77 |
| S.A. + 75% CR + 450° C/8 hrs. (B) | 80 | 73 | 83 |
| S.A. + 90% CR + 450° C/2 hrs. (C) | 86.5 | 80.5 | 77 |
| (A) + 75% CR | 102 | 95 | 71 |
| (B) + 75% CR | 98.5 | 92 | 77.5 |
| Literature Processing (1) | | | |
| S.A. + 60% RA + 450° C/½ hr. + 75% RA | 97 | — | 72 |

(1) P. W. Taubenblatt et al., Metals Engineering Quarterly November 1972, Volume 12, p. 41.

The results presented in Table I indicate that the optimum combination of strength and electrical conductivity is attained in the alloy of the present invention by aging solution annealed material, which has been cold worked a minimum of 75 percent, at a temperature of 450° C for from 2 to 8 hours. A higher initial cold reduction results in higher aged strength values while longer aging times provide higher electrical conductivity values in both the aged condition and after final cold reduction. The properties attained by the alloy of the present invention are superior to the properties reported for the literature alloy at similar processing.

EXAMPLE II

The niobium-containing alloy system of Example I was aged at 450° C for 8 hours. Alloy systems containing chromium, zirconium, vanadium and copper were aged under similar conditions. These vanadium containing alloys were known respectively as A126 (Cu-0.50% Cr-0.16% Zr-0.36% V), A293 (Cu-0.50% Cr-0.29% Zr-0.38% V) and A318 (Cu-0.42% Cr-0.23% Zr-0.37% V). The Vickers hardness and % IACS conductivity values were measured for each alloy. The results are shown in Table II.

TABLE II

HARDNESS AND ELECTRICAL CONDUCTIVITY COMPARISONS

| Alloy | Vickers Hardness Kg/mm² | % IACS |
|---|---|---|
| Example I - NB | 179 | 83 |

TABLE II-continued

| HARDNESS AND ELECTRICAL CONDUCTIVITY COMPARISONS | | |
|---|---|---|
| Alloy | Vickers Hardness Kg/mm² | % IACS |
| A126 | 178 | 81 |
| A293 | 182 | 79.5 |
| A318 | 180 | 80 |

The average values for the vanadium containing alloys are a Vickers hardness of 180 and a % IACS of 80. This compares to the 179 Vickers hardness and 83% IACS displayed by the alloy system of the present invention. It is evident from such results that the alloy system of the present invention, for equivalent hardness values, exhibits an absolute increase of 3% in IACS conductivity over alloys containing vanadium which have been utilized for the same purposes as the alloy system of the present invention. Therefore, the alloy system and processing of the present invention provides for an increase in electrical conductivity properties but not at the expense of strength or hardness properties for the alloy.

EXAMPLE III

An alloy having a composition of 0.5% by weight chromium, 0.14% by weight zirconium, balance essentially copper was processed according to sequence (B) in Table I of Example I plus an additional 75% cold working. The strength and conductivity values for this alloy system are shown in Table III.

TABLE III

| ELECTRICAL CONDUCTIVITY AND STRENGTH COMPARISON PROPERTIES | | | |
|---|---|---|---|
| Processing | UTS (ksi) | 0.2% YS (ksi) | % IACS |
| S.A. + 75% CR + 450° C/8 hrs. + 75% CR | 97 | 90.5 | 72.5 |

The results presented in Table III indicate that an alloy system similar to the alloy presented in Example I but lacking niobium does not give the desired combination of high strength and high electrical conductivity that the system of Example I with niobium exhibits in Table I. Such a system without niobium has properties which are quite similar to the literature processing results presented in Table I. Therefore, it is the combination of the novel alloy system and the processing of the present invention which provides for an increase in electrical conductivity properties but not at the expense of strength properties for the alloy.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A copper base alloy which exhibits a combination of high strength and high electrical conductivity, said alloy consisting essentially of 0.05 to 1.25% by weight chromium, 0.05 to 1.0% by weight zirconium, 0.05 to 1.5% by weight niobium, balance copper.

2. A process for improving both the strength and electrical conductivity properties of copper base alloys, which comprises:

a. casting a copper base alloy consisting essentially of 0.05 to 1.25% by weight chromium, 0.05 to 1.0% by weight zirconium, 0.05 to 1.5% by weight niobium, balance copper;

b. hot working the alloy at a starting temperature of 950°-1000° C to effect the maximum solid solution of all alloying elements;

c. rapidly cooling the alloy to maintain said maximum solid solution of all alloying elements;

d. cold working the alloy to a total reduction of at least 60%; and e. aging said alloy at 400°-500° C for one to 24 hours.

3. A process for improving both the strength and electrical conductivity properties of copper base alloys, which comprises:

a. casting a copper base alloy consisting essentially 0.05 to 1.25% by weight chromium, 0.05 to 1.0% by weight zirconium, 0.05 to 1.5% by weight niobium, balance copper;

b. hot working the alloy at a starting temperature of 850°-950° C;

c. solution annealing the worked alloy at a solutionizing temperature of 950°-1000° C, for a period of time sufficient to insure the maximum solid solution of all alloying elements;

d. rapidly cooling the alloy to maintain said maximum solid solution of all alloying elements;

e. cold working the alloy to a total reduction of at least 60%; and f. aging said alloy at 400°-500° C for one to 24 hours.

4. A process as in claim 2 wherein said aging step is accomplished in cycles with said cold working, where the cycles end with either an aging or a cold working step.

5. A process as in claim 2 wherein the alloy is cast at a temperature which ranges between 25° C above the melting point of the alloy up to 1300° C.

6. A process as in claim 2 wherein said rapid cooling is sufficient to cool the alloy to at least 350° C.

7. A process as in claim 3 wherein said aging step is accomplished in cycles with said cold working, where the cycles end with either an aging or a cold working step.

8. A process as in claim 2 wherein the hot working occurs at a temperature of 975°-1000° C.

9. A process as in claim 3 wherein the solutionizing temperature is 975°-1000° C.

10. A process as in claim 3 wherein the alloy is cast at a temperature which ranges between 25° C above the melting point of the alloy up to 1300° C.

11. A process as in claim 3 wherein said rapid cooling is sufficient to cool the alloy to at least 350° C.

12. A wrought copper base alloy in the worked and aged condition having high strength and high electrical conductivity properties, said wrought alloy consisting essentially of 0.05 to 1.25% by weight chromium, 0.05 to 1.0% by weight zirconium, 0.05 to 1.5% by weight niobium, balance copper.

13. An alloy as in claim 1 wherein said alloy consists essentially of 0.5 to 1.0% by weight chromium, 0.1 to 0.4% by weight zirconium, 0.1 to 0.4% by weight niobium, balance copper.

14. An alloy as in claim 1 wherein a small but effective amount of an element selected from the group consisting of arsenic, magnesium, cobalt, boron, calcium, cadmium and mischmetal is added to said alloy.

15. A process as in claim 2 wherein said alloy consists essentially of 0.5 to 1.0% by weight chromium, 0.1 to 0.4% by weight zirconium, 0.1 to 0.4% by weight niobium, balance copper.

16. A process as in claim 2 wherein a small but effective amount of an element selected from the group consisting of arsenic, magnesium, cobalt, boron, calcium, cadmium and mischmetal is added to said alloy of step (a).

17. A wrought alloy as in claim 12 wherein said alloy consists essentially of 0.5 to 1.0% by weight chromium, 0.1 to 0.4% by weight zirconium, 0.1 to 0.4% by weight niobium, balance copper.

18. A wrought alloy as in claim 12 wherein a small but effective amount of an element selected from the group consisting of arsenic, magnesium, cobalt, boron, calcium, cadmium and mischmetal is added to said alloy.

19. A process as in claim 3 wherein said alloy consists essentially of 0.5 to 1.0% by weight chromium, 0.1to 0.4% by weight zirconium, 0.1 to 0.4% by weight niobium, balance copper.

20. A process as in claim 3 wherein a small but effective amount of an element selected from the group consisting of arsenic, magnesium, cobalt, boron, calcium, cadmium and mischmetal is added to said alloy of step (a).

* * * * *

UNITED STATES PATENT AND TRADEMARK OFFICE

Certificate

Patent No. 4,049,426 Patented September 20, 1977

W. Gary Watson and John F. Breedis

Application having been made by W. Gary Watson and John F. Breedis, the inventors named in the patent above identified, and Olin Corporation, a corporation of Virginia, the assignee, for the issuance of a certificate under the provisions of Title 35, Section 256, of the United States Code, adding the names of Brain Mravic and Stanley Shapiro as joint inventors, and a showing and proof of facts satisfying the requirements of the said section having been submitted, it is this 20th day of June 1978, certified that the names of the said Brian Mravic and Stanley Shapiro are hereby added to the said patent as joint inventors with the said W. Gary Watson and John F. Breedis.

FRED W. SHERLING,

*Associate Solicitor.*